United States Patent [19]

Imai et al.

[11] Patent Number: 4,923,777

[45] Date of Patent: May 8, 1990

[54] SINGLE-COMPONENT DEVELOPING METHOD

[75] Inventors: Takashi Imai; Susumu Saito; Koichi Takashima, all of Kanagawa, Japan

[73] Assignee: Fuji Xerox Co, Ltd., Tokyo, Japan

[21] Appl. No.: 236,424

[22] Filed: Aug. 25, 1988

[51] Int. Cl.[5] ..... G03G 15/08

[52] U.S. Cl. ..... 430/120; 355/259

[58] Field of Search ..... 430/903, 122, 102, 106.6, 430/120; 355/259

[56] References Cited

U.S. PATENT DOCUMENTS 4,350,749 9/1982 Ohnuma et al. ..... 430/903

4,401,740 8/1983 Kawabata et al. ..... 430/122

*Primary Examiner*—John L. Goodrow

*Attorney, Agent, or Firm*—Finnegan, Henderson, Farabow, Garrett and Dunner

[57] ABSTRACT

A single-component developing method with the steps of forming a uniform developer layer and developing an electrostatic latent image. The uniform developer layer is formed by abutting a layer regulating member made of a plate of soft, elastic material against a developer carrier and by regulating the developer layer by urging at least one end edge on a portion of the layer regulating member against the devloper carrier. The electrostatic latent image is formed on a photosensitive material and is developed by moving a portion of the developer carrier with the uniform developer layer formed thereon opposite the photosensitive material.

8 Claims, 2 Drawing Sheets

SINGLE-COMPONENT DEVELOPING METHOD

BACKGROUND OF THE INVENTION

1. Field of Invention

The present invention relates to a single-component electro-photographic developing method in which a layer regulation member is used to form a thin layer of developer particles on a developer carrier and to apply a charge to the particles forming the layer 2. Description of the Related Art Conventional single component developing methods used in electrophotography are briefly grouped into the contact type and the non-contact type methods.

In the contact type method, a developing layer regulating member is employed to form a thin layer of developer particles on a developer carrier roll and to apply an electrical charge to the particles. There are several types of contact type layer regulating members used in a single-component developing apparatus. For example, a layer regulating member may be formed by a plate spring made of a metal having suitable elasticity, for example, phosphor bronze, silicon steel, or stainless steel, or by a plate spring made of a material such as a resin film. Alternatively, a layer regulating member may be formed of a soft elastic material held on a plate spring material so as to effectively apply a charge to a developer and to reduce stress acting on the developer. Also, a layer regulating member may be formed of a rectangular flat plate having rubber-like elasticity. Conventionally, in order to regulate a developer layer by using a layer regulating member as described above, a flat surface of the layer regulating member as shown by numeral 5 in FIG. 4 has been utilized.

Numerous disadvantages are associated with single-component development performed by using a conventional contact type layer regulating member. First, if a layer regulating member made of a plate spring material is directly urged against a developer to control a developer layer, breakage of the developer or adhesion of the developer onto the layer regulating member results over a period of use. Thus, it has not been possible to obtain a developer layer which is stable over time. Second, if a layer regulating member employing a soft elastic member is used in order to prevent breakage of the developer or adhesion of the developer onto the layer regulating member, the layer regulating member becomes worn at the portion contacting the developer carrier. This causes the contact pressure between the layer regulating member and the developer carrier to decrease gradually creating the phenomenon that the developer layer increases in thickness, or partly comes off the developer carrier. Consequently, reliability cannot be obtained over a long period of use.

The second problem is caused by solving the first problem, while the first problem is caused by solving the second problem. In either case, there is the disadvantage that the life of the layer regulating member is shortened, and it becomes necessary to replace the member by a new one within a short period of time.

SUMMARY OF THE INVENTION

It is therefore an object of the present invention to solve the foregoing problems in the prior art.

It is another object of the present invention to provide a single-component developing method in which reliability of development can be maintained over a long period of use to thereby form high-definition copies.

It is a further object of the present invention to provide a single-component developing method which solves the problems of breakage of the developer and adhesion of the developer onto the layer regulating member while solving the problems of increased developer layer thickness and the developer layer escaping from the developer carrier after a long period of use.

The present inventors have found, in attaining the present invention, that the foregoing problems in the prior can be solved if a layer regulating member is controlled so as to have a specific contacting condition when development is performed by using a single-component developing apparatus.

In order to attain the above objects, the present invention provides a single-component developing method comprising the steps of forming a uniform developer layer by abutting a layer regulating member made of a plate of soft, elastic material against a developer carrier and by regulating the developer layer by urging at least one end edge on a portion of the layer regulating member against the developer carrier; and developing an electrostatic latent image formed on a photo-sensitive material by moving a portion of the developer carrier with the uniform developer layer formed thereon to a position opposite the photo-sensitive material.

BRIEF DESCRIPTION OF THE DRAWINGS

The manner by which the above and other objects are attained will be fully apparent from the following detailed description when considered with reference to the accompanying drawings, in which:

FIG. 2(*b*) is a view for explaining the contact state of the layer regulating member;

DESCRIPTION OF THE PREFERRED EMBODIMENT

Figure 2A:
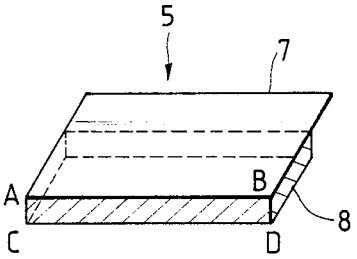
FIG. 2(*a*) is a perspective view showing a layer regulating member in accordance with the present invention.
Figure 2B:
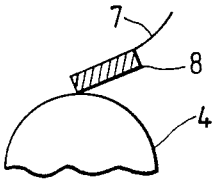

Referring to FIGS. 2(*a*) and 2(*b*), an embodiment of the present invention will be described.

FIG. 2(*a*) is a perspective view showing a layer regulating member in accordance with the present invention, and FIG. 2(*b*) is a view for explaining the state of the layer regulating member in use.

A layer regulating member 5 for use in the single-component developing method according to the present invention is formed of a plate spring material 7 and a flat plate of soft elastic material 8 having a predetermined thickness on the plate spring material 7. Alternatively, the layer regulating member may be formed of just a flat plate of soft elastic material 8 having a predetermined thickness. A metal having a suitable rigidity and elasticity such as phosphor bronze, silicon steel, or stainless steel or any other suitable material, for example, a resin film may be used as the plate spring material 7. Silicone rubber, natural rubber, SBR, acrylic rubber, fluoro-rubber, polychloroprene, or polyisoprene may be used as the soft elastic material 8. A mixture of the soft elastic material and a charge control agent may be used to improve the application of a charge to a developer. A compound for use as a toner charge modifier may be used as the charge control agent.

In accordance with the present invention, the layer regulating member 5 contacts a cylindrical, rotatable developer carrier. In this case, however, the layer regulating member 5 contacts the developer carrier so that an edge at a front end portion of the layer regulating member 5, such as the end edge C–D of the plane A–B–C–D as shown in FIG. 2(*a*), is urged against the developer carrier. Thus, the end edge contacts the developer layer on the developer carrier roll along a line parallel to the longitudinal axis of the developer carrier.

Further, the plate spring member 7 of the layer regulating member 5 may be bent, or curved, at its end edge portion adjacent the developer carrier so as to prevent flexure.

In the conventional method, a developer layer is regulated by using a lower flat surface of a layer regulating member, and therefore, a nip area is expanded by wear of the layer regulating member in a short period which reduces the pressure between the layer regulating member and the developer carrier, so that the layer cannot be effectively regulated to prevent the developer from escaping to the outside of the developing machine. In the method according to the present invention, however, expansion of a contact area between a developer carrier and a layer regulating member can be minimized in comparison with the conventional method even if the layer regulating member is worn as time passes. Therefore, the layer regulating member can be held within a range in which a developer layer is not substantially influenced in spite of a reduction of effective pressure. In accordance with the present invention the amount of wear of the layer regulating member is less than that in the conventional method. Consequently, there are the advantages that stable contact pressure can be obtained over a long period of time, and expansion of the contact area can be prevented.

EXAMPLE

The present invention will be described hereunder with respect to the following Example. The present invention, however, is not limited to the Example.

Figure 1:
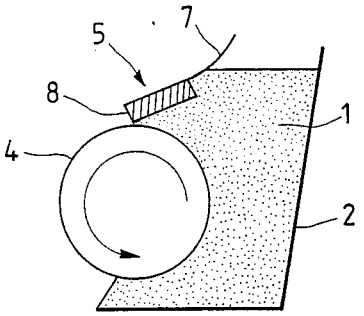
FIG. 1 is a partial schematic view of an electrophotographic developing apparatus for carrying out the method of the present invention.

FIG. 1 is a schematic view of a developing apparatus for explaining the present invention. In the developing apparatus, a stainless steel cylindrical sleeve having a diameter of 3 cm and a length of 40 cm was used as a developer carrier 4. Further, a layer regulating member 5 formed of a plate spring material 8 formed of a ½H material of SUS 304 having a thickness of 0.1 mm and a soft elastic material 7 of silicone rubber having a charge application function was used.

Composition of a developer 1 used in this experiment is as follows:

Styrene/n-butyl methacrylate (70/30) copolymer (Mn: about 15000, Mw: about 40000) 90%
Carbon black 9%
Metal containing dye 1%

The foregoing components were reduced by a roller mill, ground by a hammer mill, pulverized by means of an air jet system, and then classified to thereby obtain toner particles having a mean particle size of 12μm.

The following fine particles were added to the toner particles and agitated by a high speed mixer to thereby prepare a developer.

Hydrophobic silica 1.0 weight percent
(mean particle size 0.16μm)
(made by Nippon Aerosil Co., Ltd.)

The layer regulating member 5 was urged against the developer carrier 4 so that only one edge of the front end portion of the layer regulating member 5 was in line contact with the developer carrier 4. That is, the edge contacted the circumference of the cylindrical developer carrier 4 along a line substantially parallel to the rotational axis of the developer carrier. After the developing apparatus was disposed in opposition to a photosensitive material through a gap of 300μm, a copy test was performed at a speed of 50 A-4 sized sheets per minute while applying a developing bias voltage to the developing apparatus to obtain 100,000 copies. Even on the last copy, a satisfactory picture which was not changed from those in the initial stage was obtained.

Further, in this Example, variations in quantity of the developer and a charge per unit area on the developer carrier 4 were measured. The variations in quantity of the developer and charge per unit area were very small, as shown by the black points in FIGS. 5 and 6, and a stable operation resulted.

Figure 4:
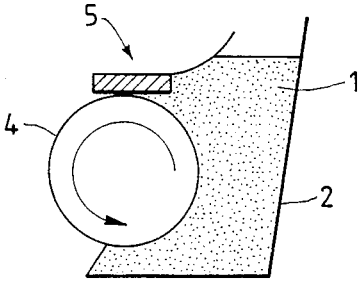
FIG. 4 PRIOR ART
FIG. 4 is a view for explaining the contact state of the layer regulating member used in the conventional method.

For the purpose of comparison, the same copy test was performed with the central portion of the underside of the layer regulating member 5 in contact with the developer carrier 4 in such a manner as shown in FIG. 4. Fog began to appear on copies after about 8,000 sheets had been copied, and it was observed that toner fell in drops from the developing apparatus onto the 10,000-th copy paper.

Figure 5:
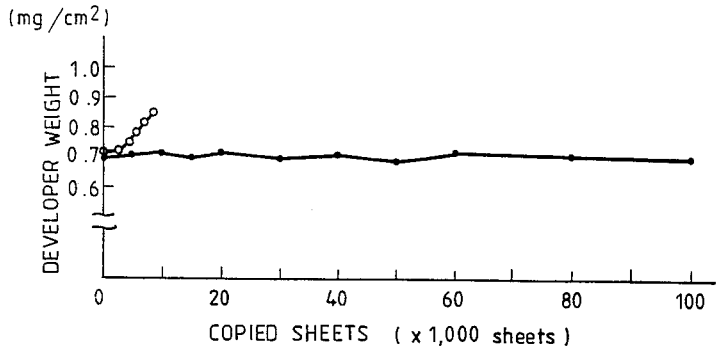
FIG. 5 is a graph showing the time aging of the developer weight in the embodiment of the present invention.
Figure 6:
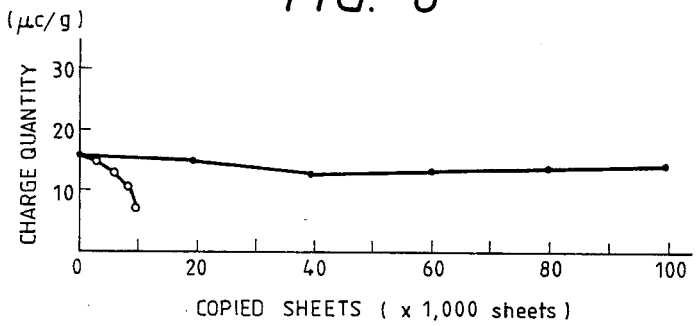
FIG. 6 is a graph showing the time aging of the quantity of charge in the embodiment of the present invention.

Further, in this comparative case, variations in the quantity of the developer and charge per unit charge of the developer carrier 4 were measured in the same manner as in the foregoing Example of the invention. FIGS. 5 and 6 show the results of measurement of the variations in quantity of the developer and a charge per unit area for the Example of the invention and for the comparative case. As shown in FIGS. 5 and 6 with circles, the variations in quantity of the developer and charge per unit area were large and the operation became unstable as time passed for the comparative case. For the Example of the invention, the quantity of the developer and the charge per unit area remained relatively constant.

Figure 3A:
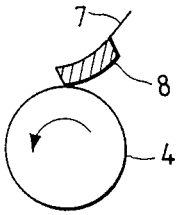
FIGS. 3(*a*), 3(*b*), and 3(*c*) are views for explaining the contact state of the layer regulating member used according to the present invention.
Figure 3B:
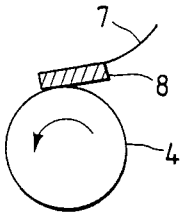
Figure 3C:
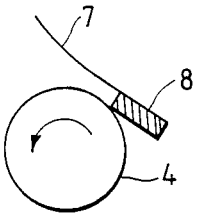

Although in accordance with the foregoing embodiment of the invention the layer regulating member 5 is urged against the developer carrier 4 so that only one corner, or end edge, of the front end portion of the soft elastic material 8 is in line contact with the developer carrier 4 as shown in FIG. 3(*a*); the embodiment may be modified such that a region of the plate adjacent to and including the one end edge of the front end portion is urged against the developer carrier 4 as shown in FIG. 3(*b*). Alternatively, it may be modified such that only one end edge of the rear end portion of the soft elastic material 8 or a region adjacent to and including the one end edge of the rear portion is urged against the developer carrier 4 as shown in FIG. 3(*c*).

Figure 7:
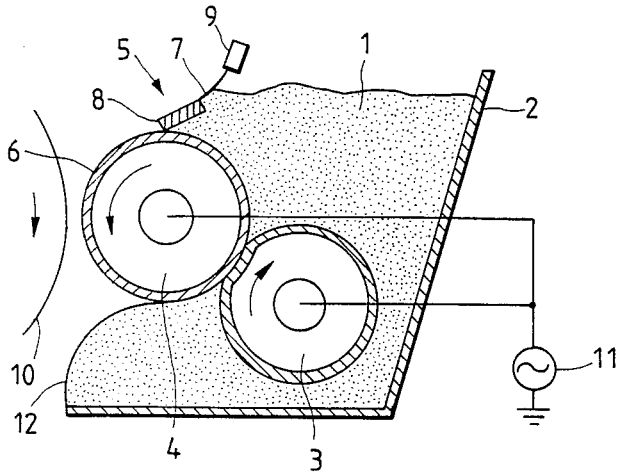
FIG. 7 is a schematic sectional view showing an example of the developing apparatus in which the method of the present invention is carried out.

FIG. 7 is a schematic sectional view showing another example of the single-component developing apparatus used for performing the single-component developing method according to the present invention. As shown in FIG. 7, the single-component developing apparatus is arranged such that a developer carrier 4, a layer regulating member 5, and a developer supplying member 3 are housed in a hopper 2.

In this apparatus, developer particles 1 in the hopper 2 are supplied onto the developer supply member 3 by gravity, and the developer carrier roll 4 rubs against the developer supply member 3 so that the developer 1 is charged by friction so as to adhere to a surface of the developer carrier roll 4. Then, the layer regulating member 5 contacts the developer on the surface of the developer carrier roll 4 so that a sufficient charge is further applied to the developer by the rubbing, and a uniform thin developer layer is formed on the surface of the developer carrier roll 4. A developer seal member 12 is provided between a lower portion of the hopper 2 and the developer carrier roll 4 so as to seal the developer in the hopper.

Having reached a developing region opposite a photo-sensitive material 10, the developer particles 1 in the form of a thin developer layer formed on the surface of the developer carrier roll 4 are attracted to and adhere to the surface of the photo-sensitive material 10 by a suitable charge of an electrostatic latent image formed on a surface of the photo-sensitive material 10 so as to make the electrostatic latent image visual. The photo-sensitive material may be, for example, a roll having a selenic material on its surface. Having passed through the developing region, the region of the carrier roll 4 which carried the developer particles passes by the developer sealing member 12 provided at the lower portion of the developing apparatus and returns to the inside of the hopper 2 with the remaining developer still attached to the surface of the developer carrier roll 4.

In the thus arranged single-component developing apparatus, the developer 1 in the hopper 2 is charged by friction between the developer supplying member 3 and the developer carrier roll 4 so as to be attached to the surface of the developer carrier roll 4. The developer 1 attached to the surface of the developer carrier roll 4 is formed into a thin layer 6 of a predetermined thickness by the layer regulating member 5. At the same time, the developer thin layer 6 is given a sufficient charge of a predetermined polarity by a rubbing action of the layer regulating member 5.

The developer carrier roll 4 is rotated while a DC-superimposed AC bias voltage is applied to the developer carrier roll 4, so that the developer thin layer 6 is moved to the developing region opposite to the photo-sensitive material 10 and is attracted to an electrostatic latent image on the photo-sensitive material 10 by an electric field between the electro-static latent image and the developer carrier roll 4 so that the developer attaches to the electrostatic latent image to thereby make the latent image visual.

In the single-component developing method according to the present invention, as described above, a flat plate of soft elastic material having a predetermined thickness is used as a layer regulating member, and a region including one end edge of a front or rear end portion of the flat plate of soft elastic material is urged against the developer carrier to thereby control the thickness of a developer layer. As seen from the comparison of the foregoing Example of the invention and a comparison case in accordance with a conventional method, the present invention has the advantages that there is no breakage of the developer layer, there is nearly no adhesion of developer to the layer regulating member, there is little variation in the thickness of the developer layer, and the developer does not escape the developer carrier even during long periods of use. Accordingly, even when copying of a large number of copies, each copy has a satisfactory picture quality.

What is claimed is:

1. A single-component developing method comprising the steps of:

forming a uniform developer layer and applying a charge to said developer by abutting a layer regulating member made of a plate spring and a plate of soft, elastic material mounted on said plate spring against a developer carrier and regulating the developer layer by urging at least one end edge of said plate of soft plastic material against the developer carrier; and developing an electrostatic latent image formed on a photo-sensitive material by moving a portion of said developer carrier with said uniform developer layer formed thereon to a position opposite said photo-sensitive material.

2. The method according to claim 1, wherein said one end edge urged against said developer carrier is on a front end portion of said plate of said layer regulating member.

3. The method according to claim 1, wherein said one end edge urged against said developer carrier is on a rear end portion of said plate of said layer regulating member.

4. The method according to claim 1, wherein a region of said plate of soft, elastic material adjacent to and including said edge is urged against said developer carrier.

5. The method according to claim 1, wherein said plate of soft, elastic material is flat.

6. The method according to claim 1, wherein said spring member has an end portion and is curbed at its end portion.

7. The method according to claim 1, wherein the thickness of said developer layer is regulated.

8. The method according to claim 1, wherein the pressure between the layer regulating member and the developer carrier is regulated.

* * * * *